US006413000B1

(12) United States Patent
Borcherds et al.

(10) Patent No.: US 6,413,000 B1
(45) Date of Patent: Jul. 2, 2002

(54) MESH SPONGE WITH FLEXIBLE POUCH

(75) Inventors: Victor Borcherds; Suzanne Borcherds, both of Thermal, CA (US)

(73) Assignee: Jean Charles Incorporated, Thermal, CA (US)

( * ) Notice: Subject to any disclaimer, the term of this patent is extended or adjusted under 35 U.S.C. 154(b) by 0 days.

(21) Appl. No.: 09/724,719

(22) Filed: Nov. 28, 2000

(51) Int. Cl.[7] ..... A46B 11/00
(52) U.S. Cl. ..... 401/118; 401/123; 206/77.1
(58) Field of Search ..... 401/118, 119, 401/123, 195; D28/63; 15/229.12, 229.13, 105; 132/286, 290; 206/730, 77.1

(56) References Cited

U.S. PATENT DOCUMENTS

| | | | | |
|---|---|---|---|---|
| 2,581,779 | A | | 1/1952 | Abraham |
| 2,585,781 | A | | 2/1952 | Johnson |
| 2,666,249 | A | | 1/1954 | Ruiz et al. |
| 2,849,821 | A | | 9/1958 | Doig |
| 3,038,187 | A | | 6/1962 | Nathanson |
| 3,146,479 | A | | 9/1964 | Stoker |
| 3,281,884 | A | | 11/1966 | Feil |
| 3,336,618 | A | | 8/1967 | Day |
| 3,345,668 | A | | 10/1967 | Forrest |
| 3,816,888 | A | | 6/1974 | Rather, Jr. |
| 3,922,407 | A | | 11/1975 | Nimmo, Jr. et al. |
| 4,034,443 | A | | 7/1977 | Turner |
| 4,112,551 | A | | 9/1978 | Sales |
| 4,199,835 | A | | 4/1980 | Heyer et al. |
| 4,454,968 | A | | 6/1984 | StLawrence |
| 4,462,135 | A | | 7/1984 | Stanford |
| 4,585,676 | A | | 4/1986 | DeSmet et al. |
| 4,659,495 | A | * | 4/1987 | Figiola ..... 252/90 |
| 4,714,182 | A | | 12/1987 | Hecht |
| 4,840,822 | A | | 6/1989 | Cheng |
| 4,919,980 | A | | 4/1990 | Pirkey |
| 5,144,744 | A | | 9/1992 | Campagnoli |
| 5,295,280 | A | | 3/1994 | Hudson et al. |
| 5,356,056 | A | | 10/1994 | Teuten |
| 5,411,188 | A | | 5/1995 | Teuten |
| 5,650,384 | A | | 7/1997 | Gordon et al. |
| 5,687,447 | A | | 11/1997 | Bynum et al. |
| 5,709,434 | A | | 1/1998 | Chen |
| 5,740,599 | A | | 4/1998 | Chang |
| 5,758,386 | A | | 6/1998 | Chen |
| 5,766,700 | A | | 6/1998 | Borcherds |
| 5,784,747 | A | | 7/1998 | Girardot et al. |
| 5,813,523 | A | * | 9/1998 | Gnadt et al. ..... 206/77.1 |
| 5,904,409 | A | | 5/1999 | Girardot et al. |
| 5,937,472 | A | | 8/1999 | Girardot et al. |
| 5,944,032 | A | * | 8/1999 | Masterson ..... 132/290 |
| 5,946,780 | A | | 9/1999 | Borcherds et al. |
| 5,970,566 | A | | 10/1999 | Girardot et al. |
| 6,131,234 | A | | 10/2000 | Chen |
| 6,161,246 | A | * | 12/2000 | Trachtenberg ..... 15/229.13 |

* cited by examiner

*Primary Examiner*—David J. Walczak
(74) *Attorney, Agent, or Firm*—Workman, Nydegger & Seeley

(57) ABSTRACT

A method and assembly is provided for use in marketing and supplying liquid soap for use with mesh bath sponges includes a substantial sperical mesh body formed from a polymeric netting material. A cord loop is attached and extends from the mesh body. A flexible pouch housing liquid soap is secured to the cord loop such that those who purchase the mesh sponge are enticed to use the liquid soap.

21 Claims, 3 Drawing Sheets

MESH SPONGE WITH FLEXIBLE POUCH

BACKGROUND OF THE INVENTION

1. The Field of the Invention

The present invention relates to methods and assemblies for use in marketing and providing liquid soap for use with mesh bath sponges.

2. The Relevant Technology

Mesh bath sponges are common household bath accessory which are used for the application of soap, such as during showering or bathing. A conventional mesh bath sponge is formed from polymeric mesh netting material that has been manipulated into a substantially spherical ball of irregular ruffles. A cord loop extends from the spherical mesh ball for use in handling and hanging the resulting sponge. Mesh sponges are preferred over conventional wash clothes or sponges in that they increase foaming or lathering of soap and quickly dry to prevent bacterial growth.

Although mesh sponges can be used with conventional bar soap, the soap industry seeks to market liquid soap for use with mesh bath sponges. During use, the liquid soap is applied to the mesh sponge. As the mesh sponge is manipulated between the hands or applied against the body, the mesh sponge foams the liquid soap for a more effective application of the soap. Competing soap industries have attempted various approaches to market and entice consumers to both purchase their brand of liquid soap and to use the soap with mesh sponges. Such use is desirable to bring additional sales.

In one approach, liquid soap companies have packaged a mesh sponge as a free accessory with each bottle of soap. Because mesh sponges are relatively inexpensive, however, this approach has minimal success in attracting consumers who traditionally use other brands of liquid soap. Accordingly, what is needed are new and effective ways for specific soap companies to advertise and promote the use of their liquid soap with mesh bath sponges.

BRIEF SUMMARY OF THE INVENTION

The present invention provides methods and assemblies to enable a soap manufacturer to both effectively promote and provide liquid soap for use with mesh bath sponges. The invention includes a substantially spherical mesh sponge formed from a polymeric netting material. A cord loop is attached to and extends from the mesh sponge. A flexible pouch which houses liquid soap and displays the manufactures brand name and/or trademarks is secured to the cord loop. The flexible pouch can be secured to the cord loop in a variety of different ways. For example, the flexible pouch can be folded over or otherwise attached to the cord loop by the use of an adhesive, clip, staple, or other conventional attachment devices. The cord loop can also be passed through holes formed on the flexible pouch. Although less practical, it is also appreciated that the flexible pouch can be directly attached to die spherical mesh body using the same type of attachment devices.

The resulting combination of mesh sponge and flexible pouch is distributed to and sold as a discrete unit in retail stores. By selling the flexible pouch containing liquid soap as a free sample with the sponge, the soap manufacturer is able to effectively promote the use of liquid soap with mesh sponges while simultaneously promoting its brand of liquid soap. For example, selling the mesh sponge with the flexible pouch of liquid soap creates a clear association between the two products. Furthermore since the flexible pouch is attached to the mesh sponge, the flexible pouch will also likely be stored with the sponge until use. As such, there is a greater likelihood that the liquid soap will be tried during the initial use of the sponge. In addition, since the flexible pouch is attached to the sponge, the soap manufacturer is able to market directly to consumers who are most likely to purchase liquid soap. Likewise, since the mesh sponges are purchased by a wide variety of consumers who may be using different brands of soap, the soap manufacturer is also able to effectively market to customers currently using competing products.

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and features of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Figure 1A:
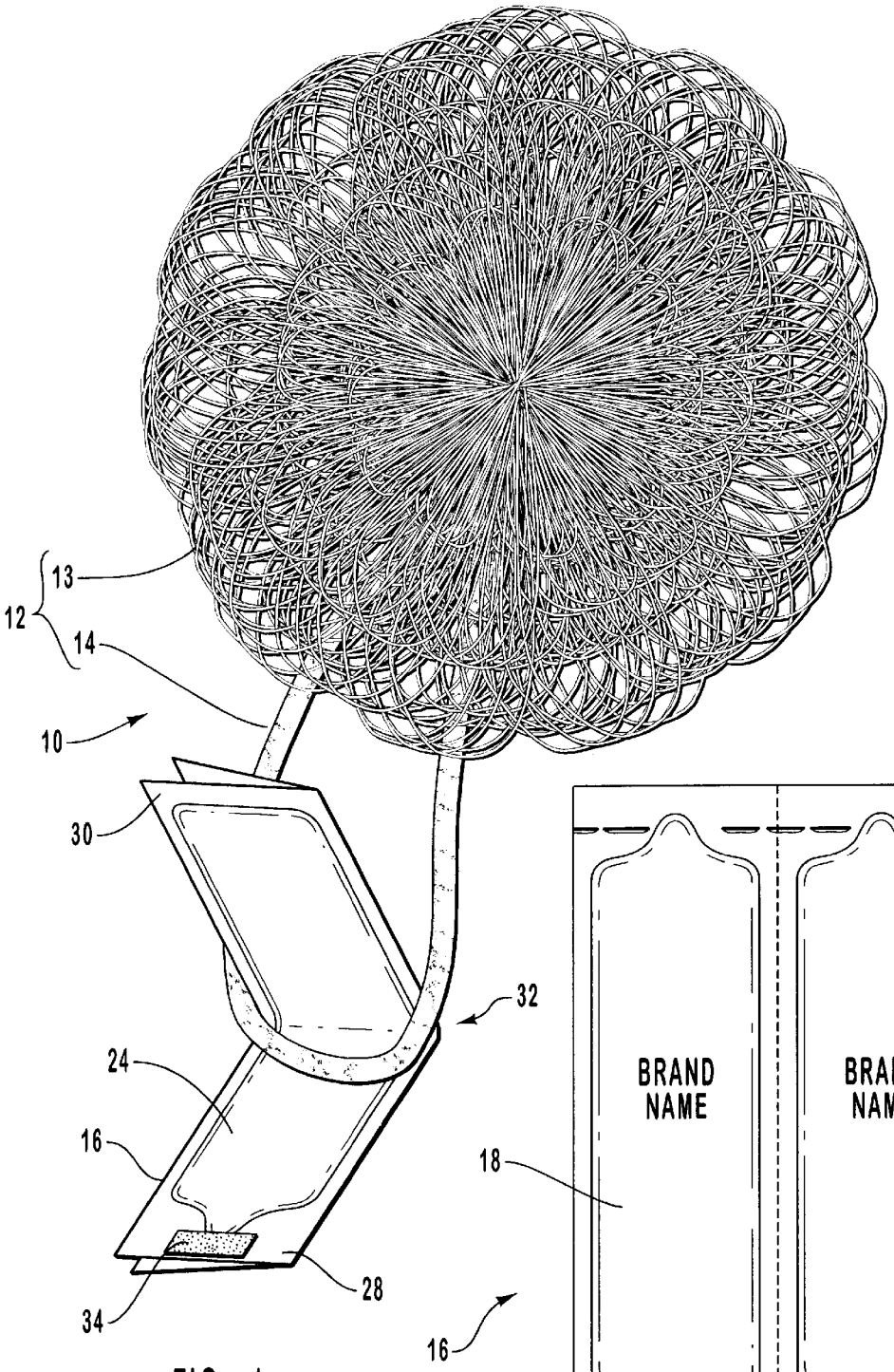
FIG. 1*a* is a perspective view of a flexible pouch being folded over the cord loop of a mesh sponge.

The present invention relates to methods and assemblies for use in marketing and providing liquid soap for use with mesh bath sponges. As discussed in the background section, one of the problems in the art is the lack of an effective way for soap manufacturers to market their liquid soap for use with mesh bath sponges. One of the inventive features of the present invention is the attachment of a flexible pouch containing liquid soap to a mesh bath sponge. The resulting combination can then be promoted and sold to the consumer as a single unit.

By enabling a soap manufacturer to attach a sample of their liquid soap product contained in a flexible pouch directly to a mesh bath sponge, the resulting combination creates a direct association between liquid soap and mesh sponges. Furthermore, by enabling the soap manufacturer to label the flexible pouch with its brand name and other trademarks, the soap manufacturer is able to specifically promote its product. Since the flexible pouch is attached to the mesh sponge, the liquid soap is being provided directly to those who are most likely to use the sample. The resulting combination thus produces a highly effective form of advertising for die soap company.

For example, one conventional form of advertising liquid soap may be to mail or otherwise provide a sample of liquid soap to all residence of an area. Although such an approach provides broad advertising, it is likely that only a small percentage of the samples will ever be used, particularly with mesh bath sponges. This is because there is no direct association between the soap and the mesh bath sponge. Furthermore, many of the recipients may simply not use mesh bath sponges and thus see no need for the liquid soap. Finally, as a practical matter, many of the samples will simply be thrown away with the junk mail. This is because it is not worth the effort to try and find a convenient place to store the sample for subsequent use. As such, the soap manufacturer spends a significant amount in advertising that is not effective.

In contrast, the flexible pouches attached to the mesh sponges of the present invention are provided only to consumers who use mesh sponges and thus are more likely to use the liquid soap. Furthermore, it is intended that the flexible pouch will remain with the mesh sponge until the mesh sponge is used. That is, the flexible pouch will remain with the mesh sponge as the mesh sponge is hung in the shower, bathroom, or otherwise stored. As the sponge is first used, there is an increased probability that the flexible pouch, which is readily accessible, will be opened and used. As such, applying the flexible pouch to the mesh sponge provides a highly cost effective way of advertising and promoting the liquid soap.

Furthermore, flexible pouches are relatively inexpensive. The soap manufacturer can thus provide them free of charge as an advertising expense. This gives mesh bath sponges containing the flexible pouch an advantage in the market place over mesh bath sponges having no flexible pouch. That is, the consumer is more likely to pick a product having a free sample when choosing between products of equal quality and price. As such, a broad range of consumers who may typically use an alternative brand name of liquid soap will likely purchase the mesh sponge and try the liquid soap. The soap manufacturer is thus able to directly market to consumers who are most likely to purchase liquid soap and who may then be purchasing competing product.

Depicted in FIG. 1*a* is one embodiment of a mesh sponge and flexible pouch assembly 10 incorporating features of the present invention. Assembly 10 includes a mesh bath sponge 12 having a substantially spherical mesh body 13 with a cord loop 14 attached thereto. Mesh body 13 is typically formed from one or more elongated polymeric tubes of diamond shaped mesh netting. The tube is stretched over two or more posts into a continuous ring, tied in the middle, and then selectively released off of the posts so as to form the tube of mesh netting into a substantially spherical configuration. In one embodiment, incremental portions of the tube of netting are stretched off of the posts in a variety of different directions such that the resulting mesh body 13 is formed of randomly positioned and shaped ruffles. In alternative embodiments, the ruffles can be disposed in substantially parallel alignment.

Further disclosure and alternative methods for making the mesh bath sponge are disclosed in U.S. Pat. Nos. 5,766,700; 5,144,744; 5,709,434; 5,740,599; 5,650,384; 5,784,747; and 5,946,780 which for purposes of disclosure are hereby incorporated by specific reference. Cord loop 14 can be formed from any type of line, including sold or woven line. In one embodiment, cord loop 14 is formed from nylon strands braded or otherwise wound into a cord. Cord loop 14 can be tied to mesh body 13 as part of the manufacturing process of forming mesh body 13 or can be secured to mesh body 13 unrelated to the formation of mesh body 13. Furthermore, cord loop 14 can be directly tied, stitched, or otherwise secured to mesh body 13 such as by using some form of fastener as disclosed in the references incorporated by reference.

Depicted in FIG. 1*a* is a flexible pouch 16 partially folded over cord loop 14. Disposed with flexible pouch 16 is liquid soap. Flexible pouch 16 which houses the liquid soap can be formed using conventional methods known to those skilled in the art. As used in the specification and appended claims, the term "flexible pouch" is broadly intended to include one or more sheets of material that have either been folded over or disposed in layers and then scaled together in some manner so as to form a sealed compartment, the liquid soap being disposed within the sealed compartment.

Typically, the sheets arc formed from a flexible non-porous material. By way of example, aluminum foil, plastic film, and scaled paper can be used. The sheets can also comprise multiple layers of different materials. Furthermore, the sheets can be sealed together using any conventional method such as adhesive, heat scaling, ultrasonic sealing, radio frequency sealing, crimping, mechanical type fastening, such as Zip-Lock type sealing, or combinations thereof. The flexible pouch is typically opened by tearing the flexible pouch to access the sealed compartment housing the liquid soap. Other resealable types of sealings can be opened by their conventional method.

Figure 1B:
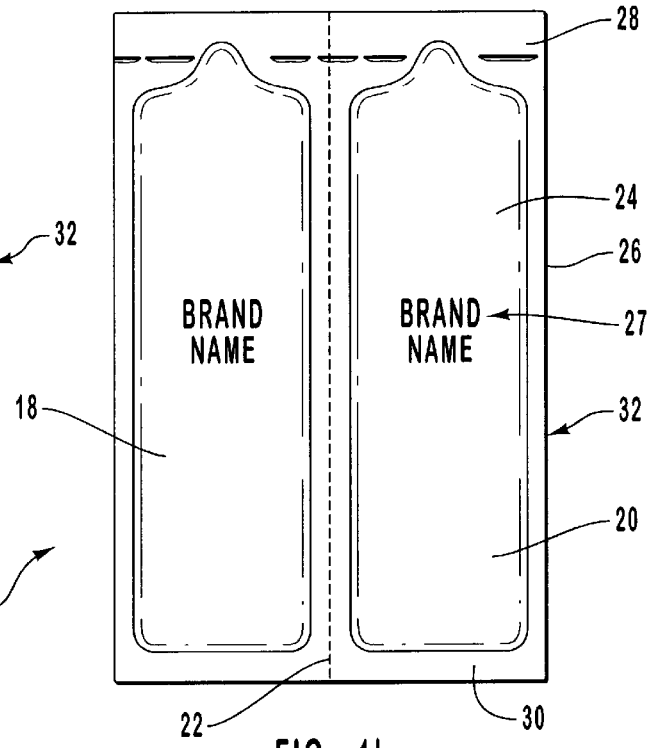
FIG. 1*b* is a front elevated view of the flexible pouch shown in FIG. 1*a;*

As depicted in FIGS. 1*a* and 1*b*, flexible pouch 16 includes a first pouch 18 and a second pouch 20 which arc adjacently secured together along a perforation line 22. In alternative embodiments, flexible pouch 16 can comprise one or three or more pouches that are secured together. Each flexible pouch 18 and 20 has a front face 24 and an opposing back face 26 that longitudinally extend between a top end 28 and an opposing bottom end 30. Disposed between opposing ends 28 and 30 is a central portion 32. Printed on the surface of each flexible pouch is brand indicia 27. Brand indicia 27 includes brand names and/or any form of trademark used to identify the product.

Although depicted as rectangular, it is appreciated that the flexible pouch can be any desired configuration, ie., round, square, triangular, or irregular. Furthermore, although each flexible pouch can be any desired size, the pouch or pouches attached to the mesh sponge are typically designed to hold liquid soap in a range between about 1.5 fluid ounces to about 0.2 fluid ounces, with about 1.0 fluid ounce to about 0.3 fluid ounces being more preferred.

The use of flexible pouches is desirable in that they are inexpensive to make, easily attached to mesh sponge 12 as disclosed herein, sufficiently strong and flexible to prevent unwanted rupture, and easily folded and manipulated for packaging. In alternative embodiment, however, it is appreciated that other types of containers can be filed with liquid soap and secured to mesh sponge 12. Examples of other types of containers include tubes, cartons, bottles, and the like.

The present invention also provides means for securing flexible pouch 16 to loop cord 14. By way of example and not by limitation, flexible pouches 18 and 20 are first folded together along perforation line 22. Next, an adhesive 34 is disposed on front face 24 at top end 28. Flexible pouch 16 is then folded over cord loop 14 at central portion 32. Finally, front face 24 at bottom end 30 is pushed against adhesive 34 such that top end 28 and bottom end 30 are secured together.

In one embodiment, adhesive 34 comprises double-sided sticky tape. In alternative embodiments, adhesive 34 can comprise a liquid setting adhesive such as a rubberized glue or cement or other conventional forms of glue. Furthermore, adhesive 34 need not be positioned at top end 28. Adhesive 34 can be positioned at any location on one half of flexible pouch 16 such that as flexible pouch 16 is folder over cord loop 14, the opposing half contacts adhesive 34 so as to secure the opposing sides together, thereby securing flexible pouch 16 to cord loop 14. It is also appreciated that opposing sides of flexible pouch 16 can be secured together by stitching, heat scaling, ultrasonic sealing, radio frequency sealing, crimping, and the like.

Figure 2A:
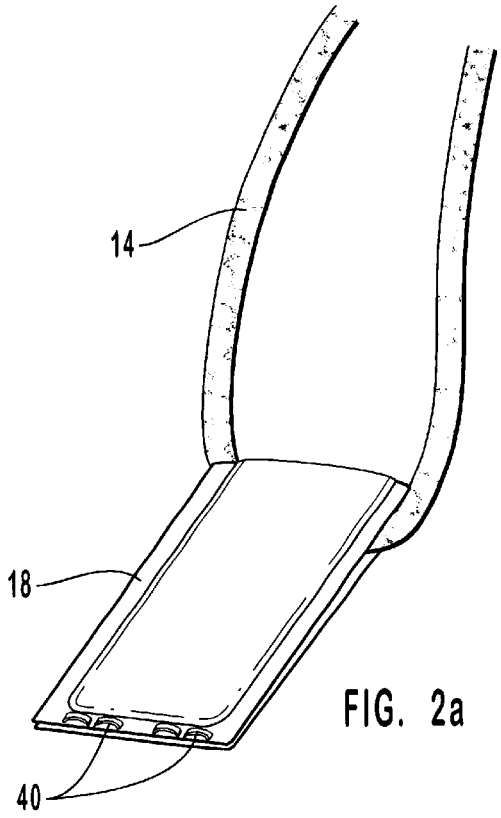
FIG. 2*a* is a perspective view of a flexible pouch being folded over and stapled together for attachment to the cord loop shown in FIG. 1*a;*
Figure 2B:
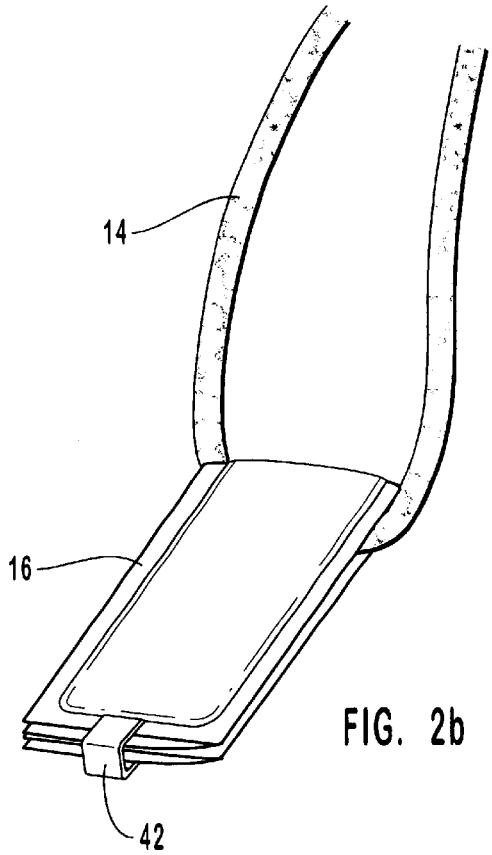
FIG. 2*b* is a perspective view of the flexible pouch shown in FIG. 1*a* being closed together by a clip.

The present invention also includes other alternative embodiments of the means for attaching. For example, depicted in FIG. 2*a*, the opposing ends of single flexible pouch 18 are secured together by staples 40 as opposed to adhesive 34. In FIG. 2*b*, the opposing ends of flexible pouch 16 are secured together by a clip 42.

Figure 3:
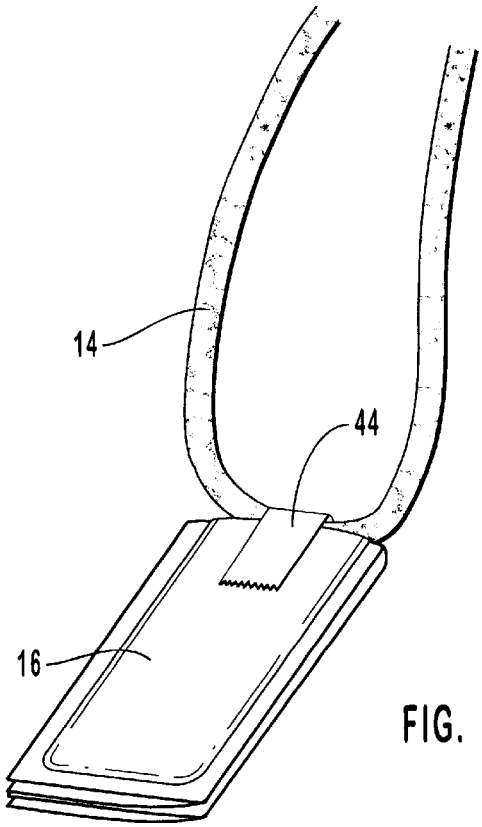
FIG. 3 is a perspective view of a flexible pouch being secured to the cord loop shown in FIG. 1*a* by tape.

In the above embodiments, flexible pouch 16 is folded over loop 14 to assist in the attachment thereto. In alternative embodiments, flexible pouch 16 need not be folded over cord loop 14. For example, depicted in FIG. 3, flexible pouch 16 is folded in half but is not folded over cord loop 14. Rather, adhesive tape 46 is folded over cord loop 14 so as to secure flexible pouch 16 to cord loop 14. In the embodiment of FIG. 3, adhesive tape 44 can be replaced with clip 42 or any other conventional attaching structure. Furthermore, flexible pouch 16 need not be folded over. That is, flexible pouch 16 can simply longitudinally extend from cord loop 14 with one end of flexible pouch 16 being attached to cord loop 14 by tape, clip, or other structure.

Figure 4:
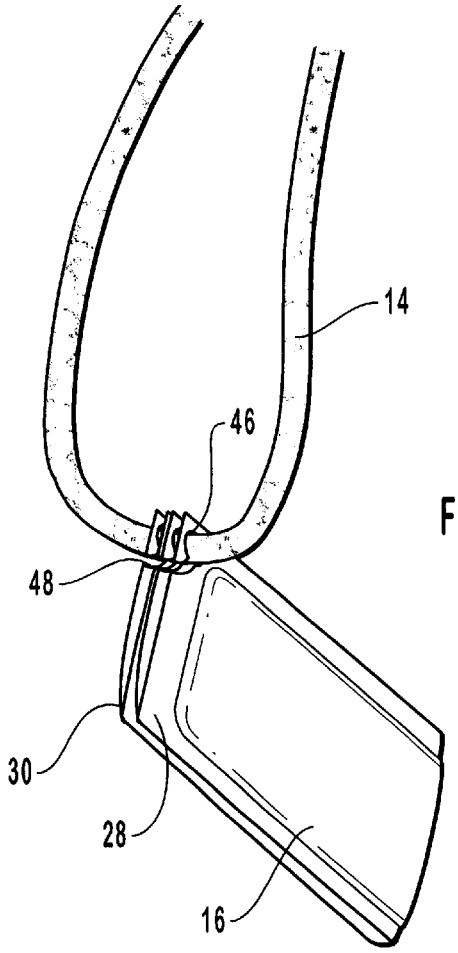
FIG. 4 is a perspective view of a flexible pouch being attached to the cord loop shown in FIG. 1*a* by way of a slotted opening.

In another alternative embodiment depicted in FIG. 4, aligned openings 46 extend through top end 28 and bottom end 30 of flexible pouch 16. A hooked slit 48 extends to each of openings 46. In this configuration, cord 14 is passed through slits 48 into opening 46 so as to secure loop cord 14 to flexible pouch 16. The hooked shape and minimum width of slits 48 substantially preclude unintentional removal of loop cord 14 from openings 46.

Figure 5:
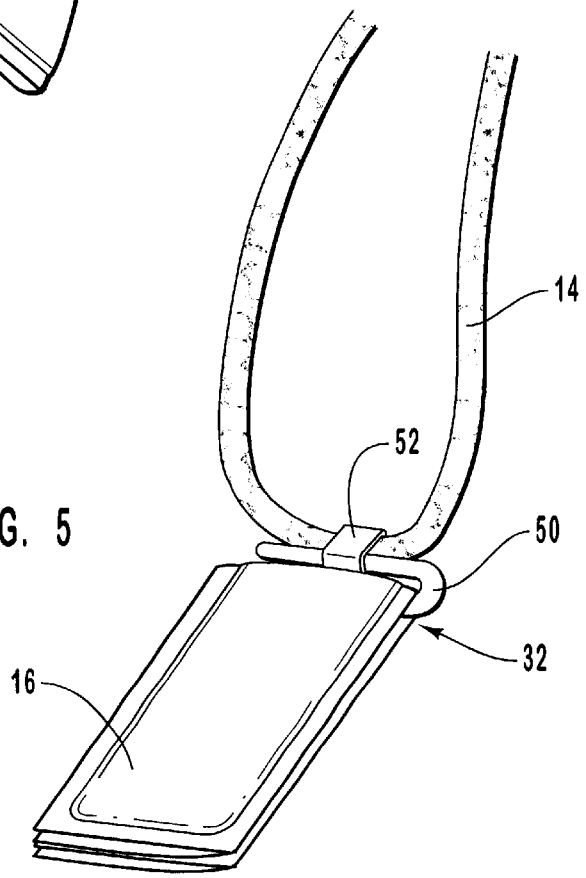
FIG. 5 is a perspective view of a flexible pouch being attached to the cord loop shown in FIG. 1*a* by a clip assembly.

Finally, in another alternative embodiment depicted in FIG. 5, a U-shaped hanger 50 attaches to central portion of flexible pouch 16. In turn, a clip 52 connects hanger 50 to cord loop 14.

It is appreciated that there are a variety of other alternative methods and structures for securing flexible pouch 16 to cord loop 14. It is also appreciated that flexible pouch 16 can be directly secured to mesh body 13 using many of the same methods and structures as disclosed herein. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A method for promoting a brand of liquid soap for use with mesh bath sponges, the method comprising:

removably securing a flexible pouch containing liquid soap to a mesh bath sponge, the flexible pouch having an exterior surface with brand indicia for the liquid soap marked thereon, the mesh bath sponge having a substantially spherical body formed from a mesh netting and a cord loop extending therefrom; and distributing the mesh bath sponge having the flexible pouch secured thereto to a retail store for sale as a unit.

2. A method as recited in claim 1, wherein the act of removably securing comprises:

folding the flexible pouch over a portion of the cord loop so as to form the flexible pouch into two halves; and securing the two halves of the flexible pouch together using an adhesive.

3. An assembly comprising:

a substantially spherical mesh body;

a cord loop attached to and extending from the mesh body;

a flexible pouch housing liquid soap; and means for securing the flexible pouch to the cord loop.

4. An assembly as recited in claim 3, wherein the mesh body is formed from an elongated tube of mesh netting.

5. An assembly as recited in claim 3, wherein the cord comprises wound nylon strands.

6. An assembly as recited in claim 3, wherein the flexible pouch comprises at least two discrete flexible pouches connected along perforated lines.

7. An assembly as recited in claim 3, further comprising:

the flexible pouch having a front face including a top end portion and a bottom end portion, the flexible pouch being folded over a section of the cord loop such that the top end portion and the bottom end portion are adjacently facing; and the means for securing the flexible pouch to the cord loop comprising an adhesive disposed between the adjacently facing top end portion and bottom end portion of the flexible pouch so as to secure that top end portion and bottom end portion together.

8. An assembly as recited in claim 7, wherein the adhesive comprises double sided tape.

9. An assembly as recited in claim 7, wherein the adhesive comprises rubberized cement.

10. An assembly as recited in claim 3, wherein the means for securing the flexible pouch to the cord loop comprises a clip.

11. An assembly as recited in claim 3, wherein the means for securing the flexible pouch to the cord loop comprises an opening extending through the flexible pouch, the cord passing through the opening.

12. An assembly comprising:

a substantially spherical mesh body;

a cord loop attached to and extending from the mesh body; and a flexible pouch housing liquid soap, the flexible pouch being secured to the cord loop.

13. An assembly as recited in claim 12, wherein the flexible pouch is folded over a portion of the cord loop and secured together by an adhesive.

14. An assembly as recited in claim 13, wherein the adhesive comprises two sided tape.

15. An assembly as recited in claim 12, wherein the flexible pouch is folded over a portion of die cord loop and secured together by a staple.

16. An assembly as recited in claim 12, wherein the flexible pouch is folded over a portion of the cord loop and secured together by a clip.

17. An assembly as recited in claim 12, further comprising an adhesive securing the cord to the flexible pouch.

18. An assembly as recited in claim 12, further comprising a clip securing the cord to the flexible pouch.

19. An assembly as recited in claim 12, further comprising an opening extending through the flexible pouch, the loop cord passing through the opening.

20. An assembly as recited in claim 12, wherein the flexible pouch comprises at least two discrete flexible pouches connected along perforated lines.

21. An assembly comprising:

a substantially spherical mesh body;

a cord loop attached to and extending from the mesh body; and a flexible pouch housing a liquid substance, the flexible pouch being secured to the cord loop.

* * * * *

UNITED STATES PATENT AND TRADEMARK OFFICE

CERTIFICATE OF CORRECTION

PATENT NO. : 6,413,000 B1
APPLICATION NO. : 09/724719
DATED : July 2, 2002
INVENTOR(S) : Victor Borcherds and Suzanne Borcherds It is certified that error appears in the above-identified patent and that said Letters Patent is hereby corrected as shown below:

Title Pg. Item (57)
Abstract, Ln. 1: Delete “is provided”

Title Pg. Item (57)
Abstract, Ln. 3: Change “substantial” to --substantially--

Col. 1, Ln. 10: Change “accessory” to --accessories--

Col. 1, Ln. 57: Change “die” to --the--

Col. 4, Ln. 1: Start a new paragraph with “Cord”

Col. 4, Ln. 13: Change “with” to --within--

Col. 4, Ln. 22: Change “arc” to --are--

Col. 4, Ln. 24: Change “scaled” to --sealed--

Col. 4, Ln. 27: Change “scaling” to --sealing--

Col. 4, Ln. 35: Change “arc” to --are--

Col. 4, Ln. 59: Change “embodiment” to --embodiments--

Col. 4, Ln. 65: Change “loop cord” to --cord loop--

Col. 5, Ln. 17: Change “scaling” to --sealing--

Col. 5, Ln. 26: After “over” insert --cord--

Col. 5, Ln. 41: After “cord” insert --loop--

Col. 5, Lns. 42 & 45: Change “loop cord” to --cord loop--

UNITED STATES PATENT AND TRADEMARK OFFICE

CERTIFICATE OF CORRECTION

PATENT NO. : 6,413,000 B1
APPLICATION NO. : 09/724719
DATED : July 2, 2002
INVENTOR(S) : Victor Borcherds and Suzanne Borcherds It is certified that error appears in the above-identified patent and that said Letters Patent is hereby corrected as shown below:

Col. 6, Ln. 63: Change "die" to --the--

Signed and Sealed this

Nineteenth Day of February, 2008

JON W. DUDAS
*Director of the United States Patent and Trademark Office*